US006321645B1

(12) United States Patent
Pollock

(10) Patent No.: US 6,321,645 B1
(45) Date of Patent: Nov. 27, 2001

(54) VACUUM-ASSISTED PARTICULATE MATERIAL DENSIFICATION SYSTEM

(76) Inventor: John Pollock, 202 Industrial, Garnett, KS (US) 66032

( * ) Notice: Subject to any disclaimer, the term of this patent is extended or adjusted under 35 U.S.C. 154(b) by 0 days.

(21) Appl. No.: 09/471,624

(22) Filed: Dec. 24, 1999

(51) Int. Cl.[7] ..... B30B 5/00
(52) U.S. Cl. ..... 100/251; 100/218
(58) Field of Search ..... 100/127, 229 R, 100/218, 251; 53/529

(56) References Cited

U.S. PATENT DOCUMENTS

| | | | | |
|---|---|---|---|---|
| 3,070,003 | * | 12/1962 | Stacy | 100/251 |
| 3,664,385 | | 5/1972 | Carter . | |
| 3,991,910 | | 11/1976 | Leonard . | |
| 4,041,855 | * | 8/1977 | Egosi | 100/218 |
| 4,110,954 | | 9/1978 | Olsson et al. . | |
| 4,127,062 | * | 11/1978 | Egosi | 100/251 |
| 4,136,767 | | 1/1979 | Sarovich . | |
| 4,560,060 | | 12/1985 | Lenhart . | |
| 4,595,501 | | 6/1986 | Queyroix . | |
| 4,703,782 | | 11/1987 | Henkel, Sr. . | |
| 5,533,955 | | 7/1996 | Cann et al. . | |
| 5,943,846 | * | 8/1999 | Pollock | 100/218 |
| 6,112,501 | * | 9/2000 | Pollock | 100/218 |

* cited by examiner

*Primary Examiner*—Peter Vo
*Assistant Examiner*—Louis K. Huynh
(74) *Attorney, Agent, or Firm*—Dale J. Ream

(57) ABSTRACT

A system for forming particulate material in a bulk form comprises a compression tower having a top and sides depending therefrom. A compression chamber having side walls and an open bottom is reciprocatively mounted to said tower for deposit of loose particulate material therein. The system further includes a first conveyor assembly displaced from said tower. In its extended position, the chamber contacts the first conveyor assembly and the bottom of the chamber is closed thereby. A vacuum blower draws loose particulate material into the chamber through an inlet and compresses it against the first conveyor assembly. A ram assembly within the chamber further compresses the loose material into a bulk form atop the conveyor belt. When the chamber and ram assembly are returned to their retracted positions, the material bulk is transferred downstream by the first conveyor assembly to a space between vertically spaced second and third conveyor assemblies.

20 Claims, 12 Drawing Sheets

VACUUM-ASSISTED PARTICULATE MATERIAL DENSIFICATION SYSTEM

BACKGROUND OF THE INVENTION

The present invention relates generally to a particulate material densification system and, more particularly, to a vacuum-assisted system for forming bulk particulate material into a desired bulk form with minimal fibrous lumps.

Various devices have been proposed for shaping and packaging particulate material into a bulk form. Certain devices first compress the material into a bulk form and ram-direct the bulk into a preformed plastic bag. One problem with these devices is that the movement of the material bulk from one station to the other dislodges portions of the material from the previously shaped bulk, particularly at the corners thereof. This material separation can occur during ram induced transport particularly when directed through a downstream chamber such that friction arises. The resulting friction dislodges particulates from the material bulk, particularly at the corners thereof and forms fibrous lumps of material. Fibrous lumps in the particulate material cause an uneven material bulk, which precludes easy palletization and unnecessary waste of the particulate material.

While the packaging system shown in U.S. Pat. No. 5,943,846, granted to this inventor, solves many of the above mentioned problems, a system which provides an optimally densified material bulk which minimizes or even precludes fibrous lumps therein is still needed.

SUMMARY OF THE INVENTION

In response thereto, the present invention provides a system for vacuum-assisted densification of particulate material which comprises a vertical compression tower having walls and a top. A compression chamber having a series of sides and open upper and lower ends is reciprocatively mounted to the tower with piston/cylinder assemblies. A ram assembly is mounted to the top of the tower and extends downwardly through the chamber. The ram assembly includes a piston/cylinder assembly having a compression plate attached to a rod thereof for extension through the chamber.

The system also includes a conveyor assembly positioned below the tower and having a perforated conveyor belt extending thereabout. The chamber is selectably extendable between a first position displaced from the conveyor assembly and a second position adjacent the conveyor assembly. The conveyor assembly includes an air chamber that is coupled to a vacuum blower such that air within the chamber may be evacuated through the perforated conveyor belt when the chamber is in the second position.

Accordingly, particulate material can be drawn into the compression chamber and onto the conveyor belt when the compression chamber is lowered to its second position. As air is withdrawn therefrom through the perforated conveyor belt, the particulate material is compressed into bulk form upon the conveyor belt. The ram assembly is then extended to further compress the particulate material into bulk form. The chamber then returns to a position displaced from the conveyor assembly and an operation of the conveyor assembly conveys the bulk to a downstream location for packaging.

Therefore, it is a general object of this invention to provide a system for compressing particulate material into bulk form which uses negative air pressure to draw particulate material into a compression chamber.

Another object of this invention is to provide a system, as aforesaid, which utilizes a reciprocating compression chamber and a reciprocating ram assembly.

Still another object of this invention is to provide a system, as aforesaid, in which the open lower end of the compression chamber is closed upon lowering the chamber to bear against a conveyor assembly.

Yet another object of this invention is to provide a system, as aforesaid, which first compresses particulate material by evacuating air from the compression chamber.

A still further object of this invention is to provide a system, as aforesaid, which evacuates air from the air chamber through a perforated conveyor belt.

A particular object of this invention is to provide a system, as aforesaid, which diminishes the separation of the particulate material from the material bulk.

Another particular object of this invention is to provide a system, as aforesaid, which diminishes the production of fibrous lumps in the material bulk.

A further object of this invention is to provide a system, as aforesaid, in which the compression chamber retracts from the conveyor assembly after a material bulk is compressed by the ram assembly.

A still further object of this invention is to provide a system, as aforesaid, wherein the height of the material bulk can be regulated thereby providing for packaging weight modifications without deviance from the optimum length and width requirements necessary for palletization.

Other objects and advantages of this invention will become apparent from the following description taken in connection with the accompanying drawings, wherein is set forth by way of illustration and example, an embodiment of this invention.

DESCRIPTION OF THE PREFERRED EMBODIMENT

The preferred embodiment of the vacuum-assisted particulate material densification system will now be described with reference to FIGS. 1–12 of the accompanying drawings.

Figure 1:
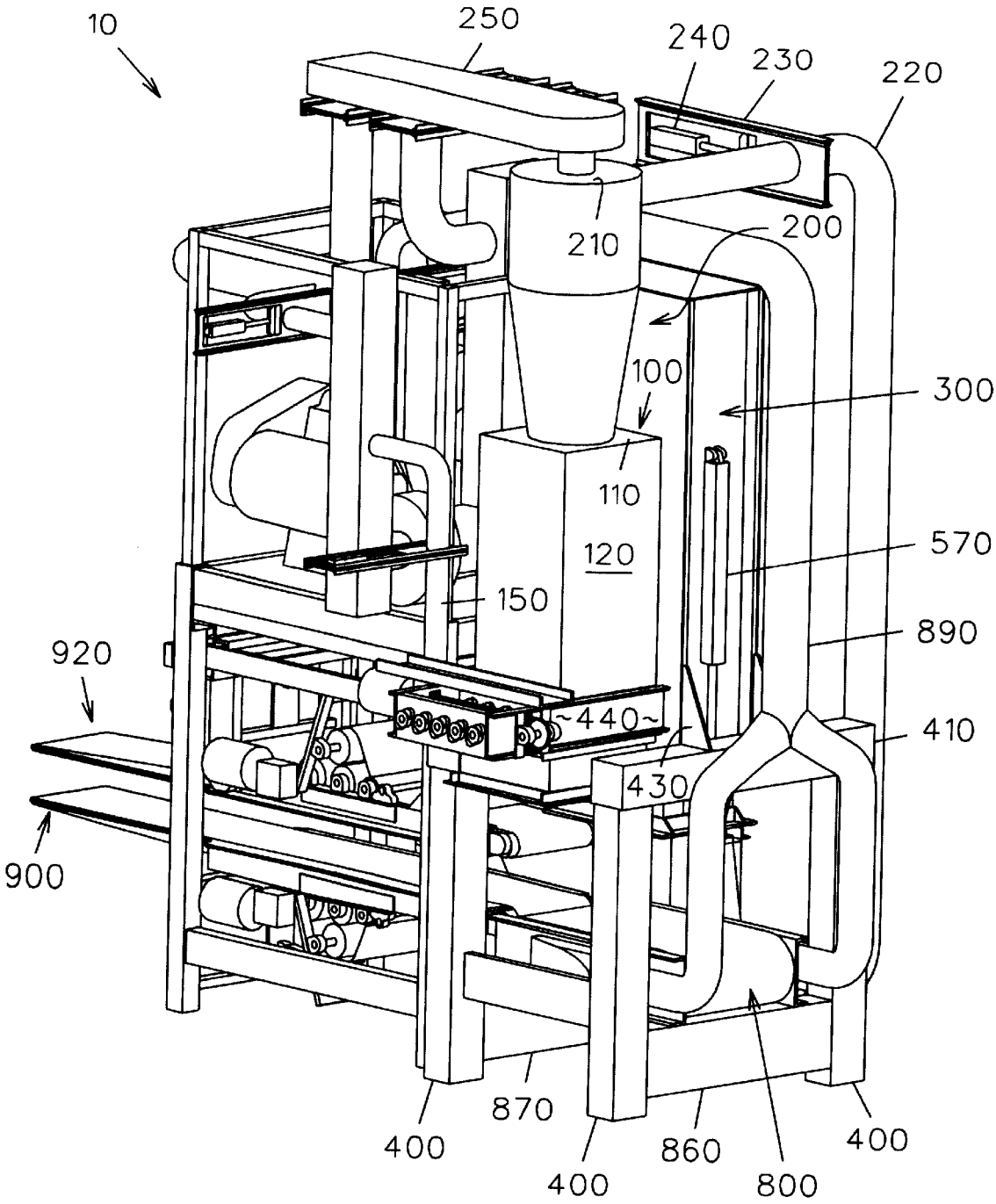
FIG. 1 is a perspective view of the vacuum assisted particulate densification system according to the present invention.

The system 10 according to the invention generally comprises a compression tower 300 for forming loose particulate material into bulk form 12 and a feed hopper 100 for preparing the loose particulate material for deposit into the compression tower 300. The feed hopper 100 is a box-like structure comprising a top wall 110 with vertical side walls 120 depending therefrom and a bottom wall (FIG. 1). A funnel-like structure or cyclone 200 having a closed top 210 and an open bottom is mounted atop the feed hopper 100. The top wall 210 of the feed hopper 100 includes an aperture having a diameter corresponding to the diameter of the open bottom of the cyclone such that particulate matter may be drawn from the cyclone 200 into the hopper 100, as to be further described below.

Figure 2:
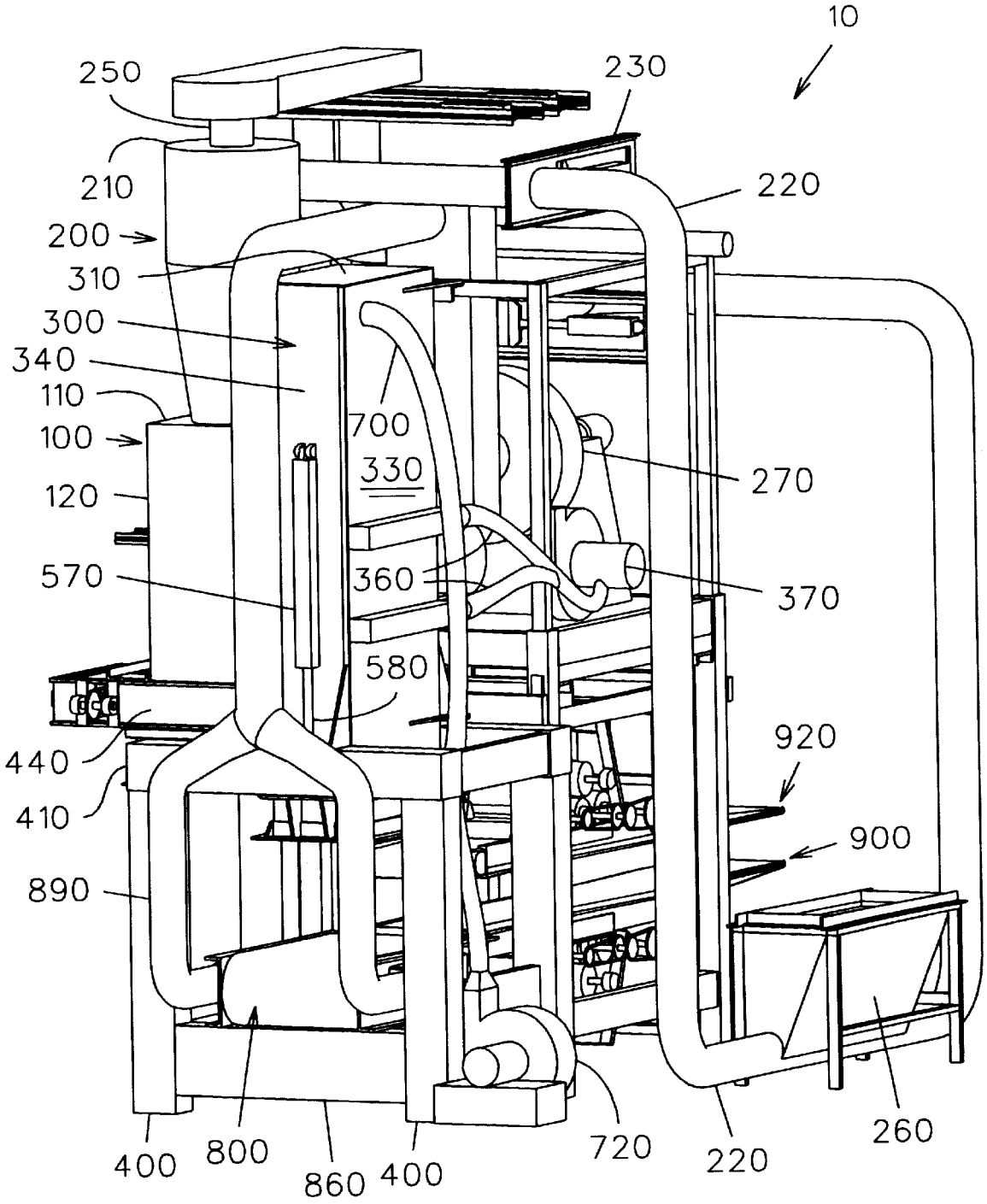
FIG. 2 is a rear perspective view of the system of FIG. 1 with the compression chamber in a retracted position.

An upstream portion 220 of a first conduit connects the cyclone 200 with a surge bin 260 containing loose particulate material (FIG. 2). A downstream portion 250 of the first conduit connects the top 210 of the cyclone 200 with a first vacuum-type blower 270. An operation of the first blower 270 causes loose particulate material to be drawn through the upstream portion 220 of the first conduit into the cyclone 200. A gate 230 having a piston/cylinder combination 240 is coupled to the upstream portion 220 of the conduit for selectably controlling the flow of air therethrough. It should also be appreciated that the upstream portion 220 of the first conduit connects to the cyclone 200 at an angle such that the particulate material is circulated or swirled therein to prevent fibrous lumps from forming.

Figure 12:
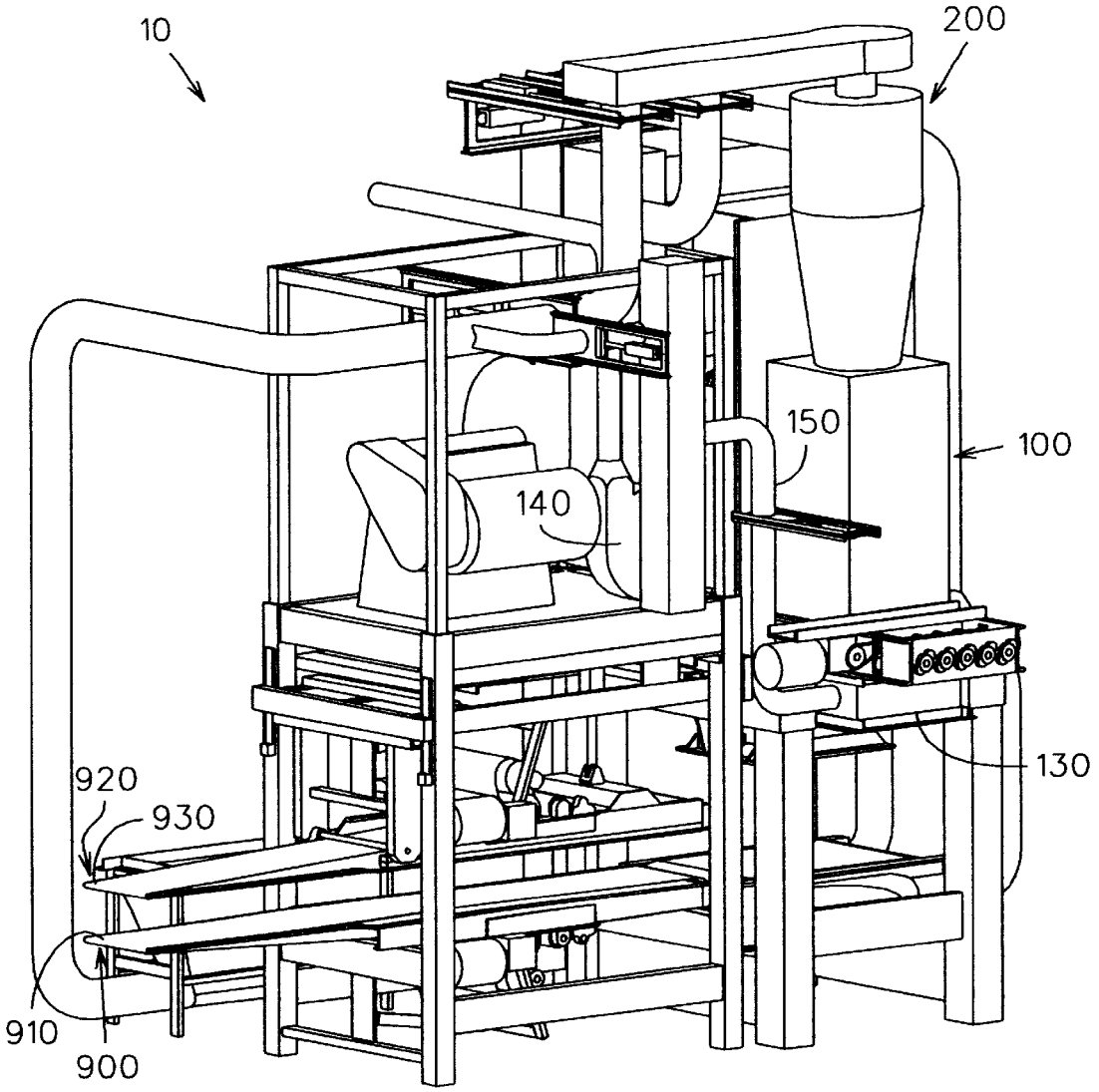
FIG. 12 is another perspective view of the system of FIG. 1.

The feed hopper 100 includes an air chamber 130 coupled to a second vacuum-type blower 140 with a conduit 150 (FIG. 12). An operation of the second blower 140 causes air to be evacuated from the feed hopper 100. This evacuation of air from the feed hopper 100 yields a negative air pressure therein, such that particulate material is drawn from the cyclone 200 into the hopper 100.

The compression tower 300 comprises a top wall 310, vertical front 320 and rear 330 walls with side walls 340 therebetween, and an open bottom. The rear wall 330 is pivotally attached to a side wall 340 such that the rear wall may be selectively opened to provide access therein. The rear wall 330 also includes a series of apertures 350 coupled to conduits 360, the conduits 360 being connected to a third vacuum-type blower 370 for selectably evacuating air from the tower 300 (FIG. 2), as to be described more fully below. The tower 300 is supported by a framework which comprises a plurality of vertical legs 400 with side cross struts 410, 420 extending therebetween. The tower 300 includes support plates 430 which rest upon the cross struts 410, 420 and are fixedly attached thereto (FIGS. 1 and 12). The feed hopper 100 is fixedly attached to the tower 300 with support braces 440.

Figure 3:
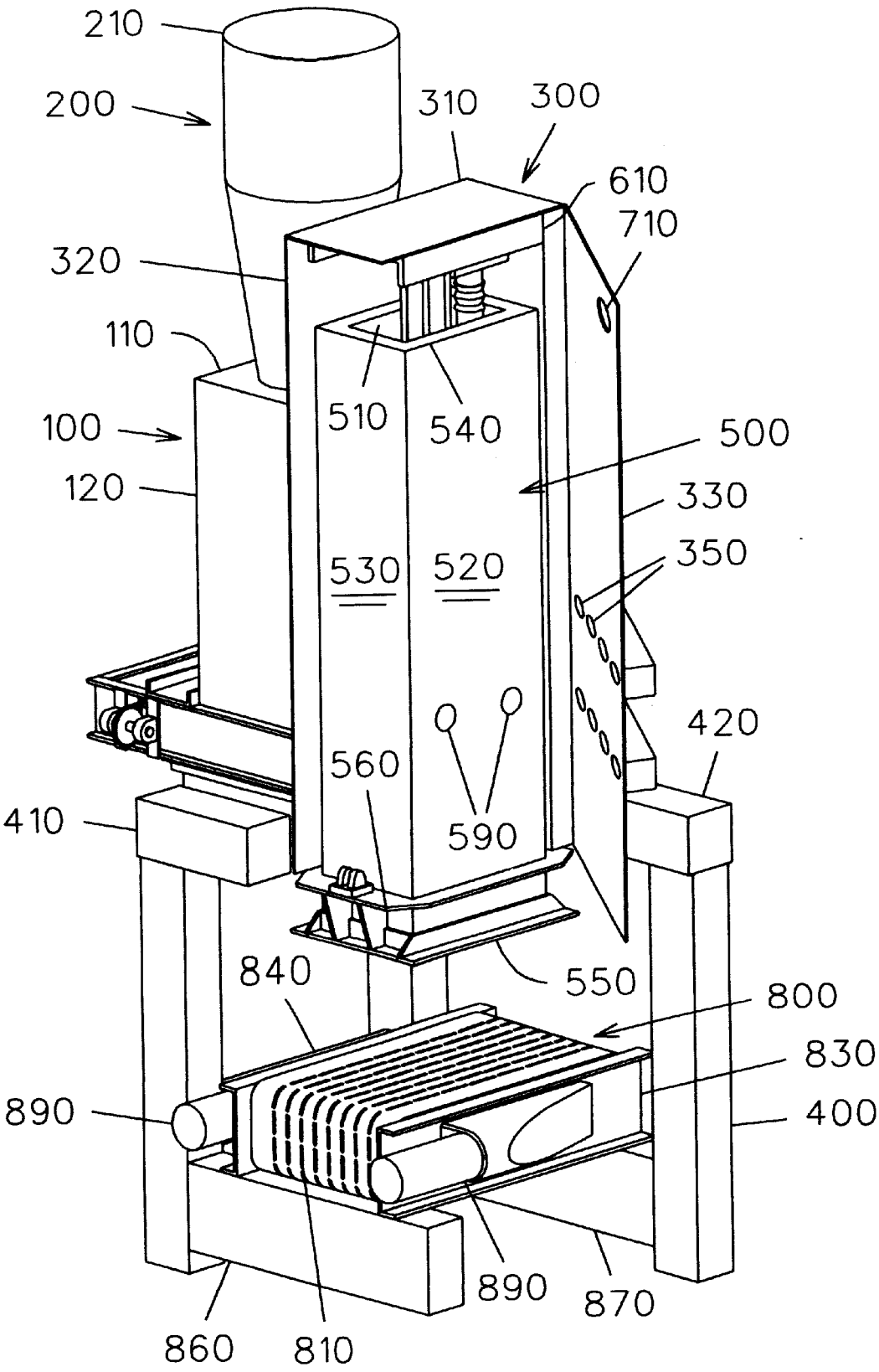
FIG. 3 is a partial perspective view of the system of FIG. 2 with portions of the tower and conduit removed.
Figure 4:
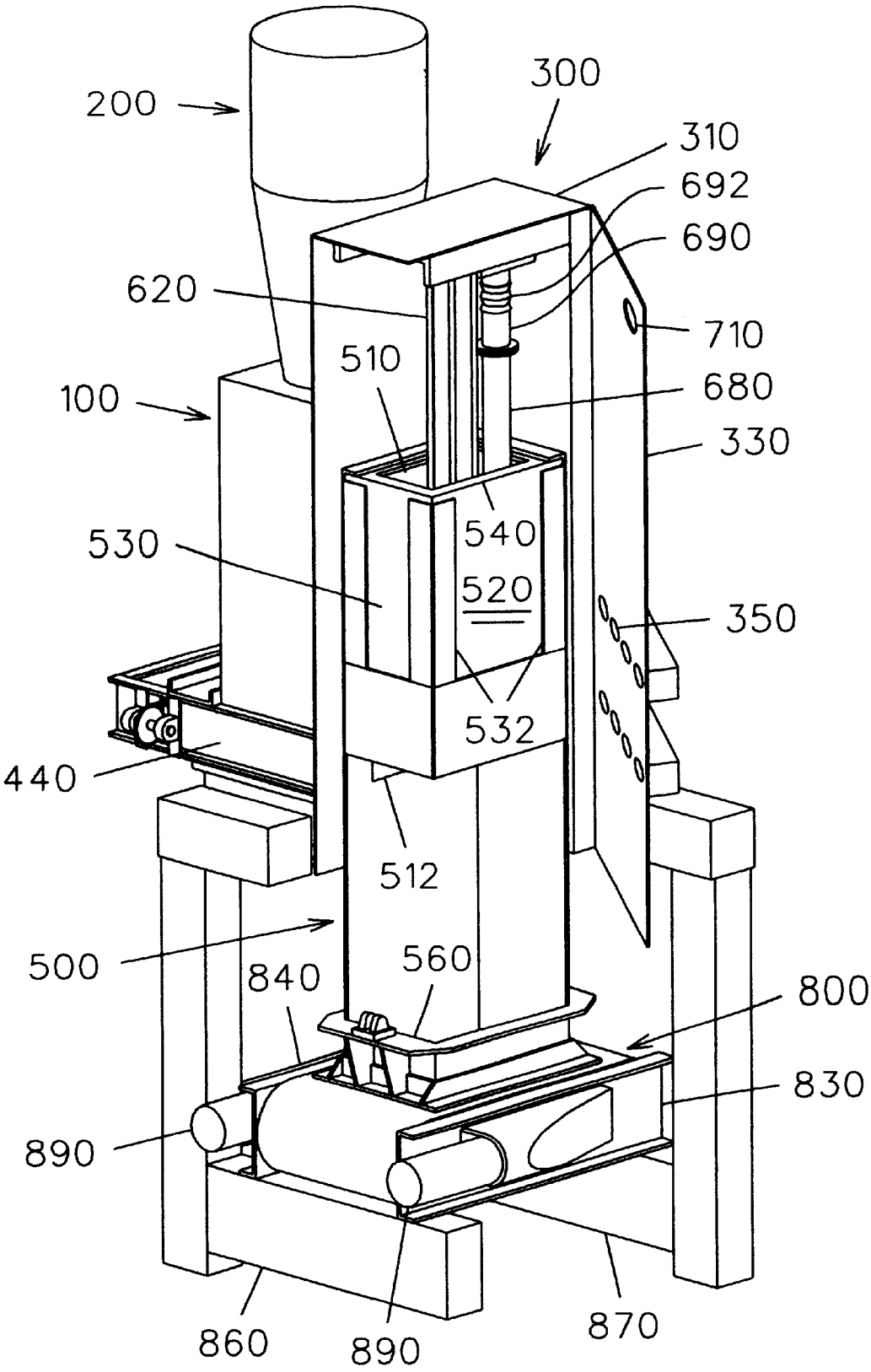
FIG. 4 is perspective view as in FIG. 3 with a portion of the compression chamber removed and the chamber in an extended position.
Figure 5:
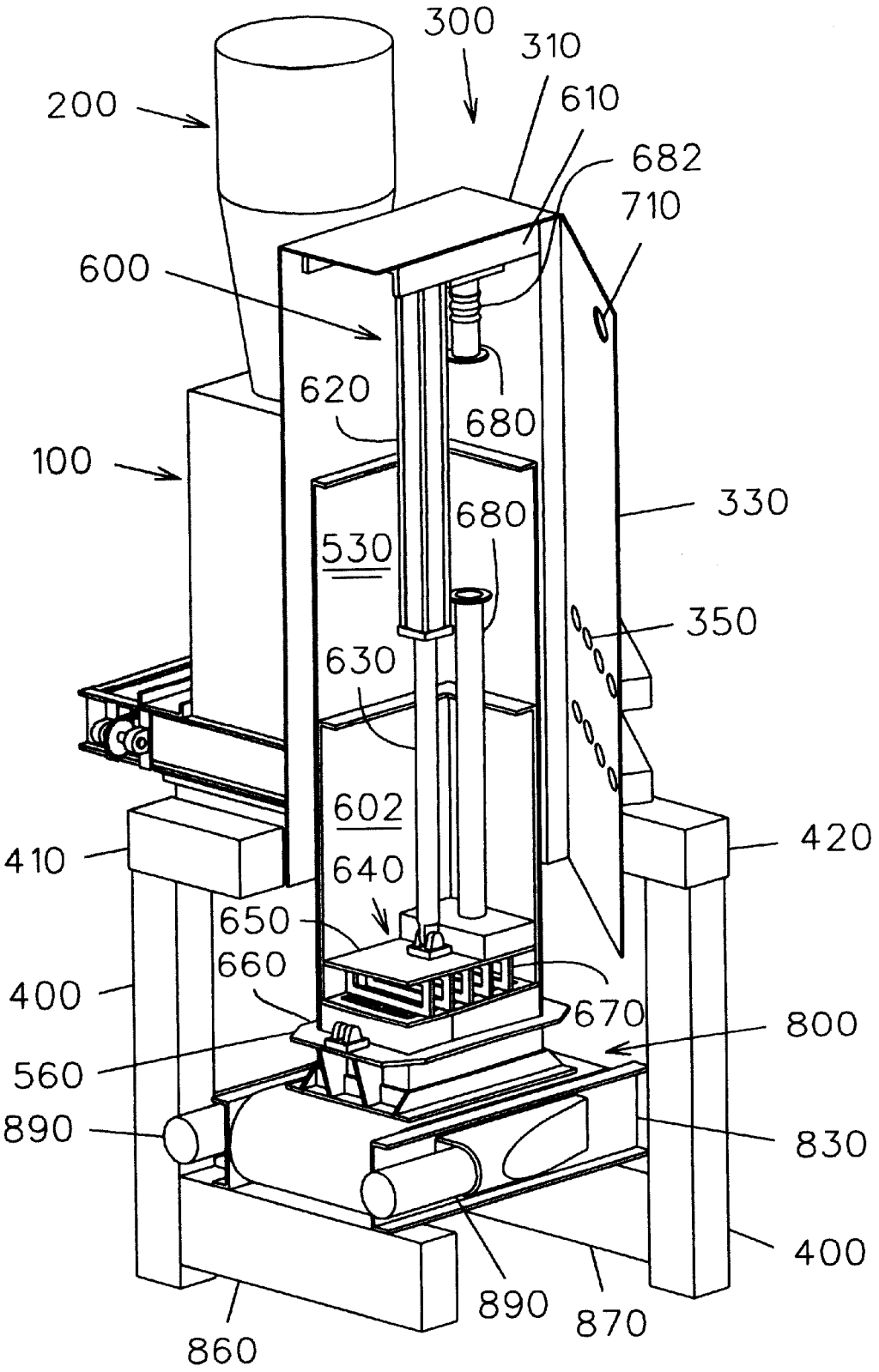
FIG. 5 is a perspective view as in FIG. 4 with an entire front and side wall removed.

Within the tower 300 is a compression chamber 500 having upstanding front 510 and rear 520 walls with side walls 530 extending therebetween (FIGS. 3–5). The upper 540 and lower 550 ends of the chamber 500 are open. A mounting plate 560 extends outwardly about the periphery of the chamber 500 adjacent the lower end 550 thereof. Piston/cylinder combinations 570 are mounted to the outer surfaces of the side walls 340 of the tower 300. Each piston/cylinder combination 570 includes a rod 580, the free end of which is fixedly attached to the mounting plate 560 of the chamber 500 such that the chamber 500 is reciprocatively movable between a first position in which the mounting plate 560 is adjacent a lower end of the tower 300 and a second position in which the lower end 550 of the chamber 500 is displaced from the lower end of the tower 300. The rear wall 520 includes a pair of apertures 590 which momentarily register with the tower apertures 350 when the chamber 500 is moving between the second extended position and the first retracted position whereby airborne particles are vacuumed from the chamber 500. Wear plates 532 extend along the edges of the walls of the chamber 500.

Particulate material may be transferred from the hopper 100 into the compression chamber 500 through openings in the walls thereof. An outlet is formed in one side wall 120 of the hopper 100. An inlet is formed in a side wall of the compression tower 300, the tower inlet registering with the hopper outlet and having a configuration that is substantially similar thereto. An inlet 512 is formed in one of the side walls 530 of the compression chamber 500 and registers with the inlet in the compression tower 300 when the compression chamber 500 is in its second lowered position and the ram assembly 600 is in a raised position, as shown in FIG. 4 and as to be further described below.

Within the tower 300 is a mounting plate 610 adjacent the top wall 310 with a piston/cylinder combination 620 depending therefrom and extending through the open top of the compression chamber 500 (FIGS. 3–5). A compression assembly 640 is attached to the free bracketed end of the reciprocating rod 630 of the piston/cylinder combination 620, the compression assembly 640 having a configuration generally congruent to the lower open end of the compression chamber 500. The piston rod 630 is reciprocatively extendable between a first retracted position in which the compression assembly 640 is upwardly displaced from the lower end 550 of the chamber 500 (FIG. 4) and a second extended position in which the compression assembly 640 is substantially adjacent the lower end 550 of the chamber 500 (FIG. 5).

The compression assembly 640 is a box-like structure having side walls 602 and an open upper end and a lower end. The lower end comprises a top plate 650 and a porous bottom plate 660 with a series of upstanding support plates 670 intermediate the top 650 and bottom 660 plates (FIG. 5). A lower portion 680 of a conduit is in communication with the space between the top 650 and bottom 660 plates and extends upwardly therefrom. An upper portion 690 of the conduit extends downwardly from the top wall 310 of the tower 300 and is connected to the first blower 270. The upper portion 690 includes a flexible segment 692. The upper 690 and lower 680 portions of the conduit register when the ram assembly 600 is in a retracted position such that air is evacuated from the chamber 500. Further, air is free to escape through the porous bottom plate 660 and lower portion 680 of the conduit when the ram assembly 600 is extended to compress the particulate material.

After an extension of the ram assembly 600 to compress the particulate material, air is forced into the compression chamber 500 through a conduit 700 which extends from an aperture 710 in the rear wall 330 of the tower 300 to a fourth blower 720 (FIG. 2). This addition of positive air pressure into the chamber 500 aids separation of the compression assembly 640 from the compressed material bulk.

Figure 6:
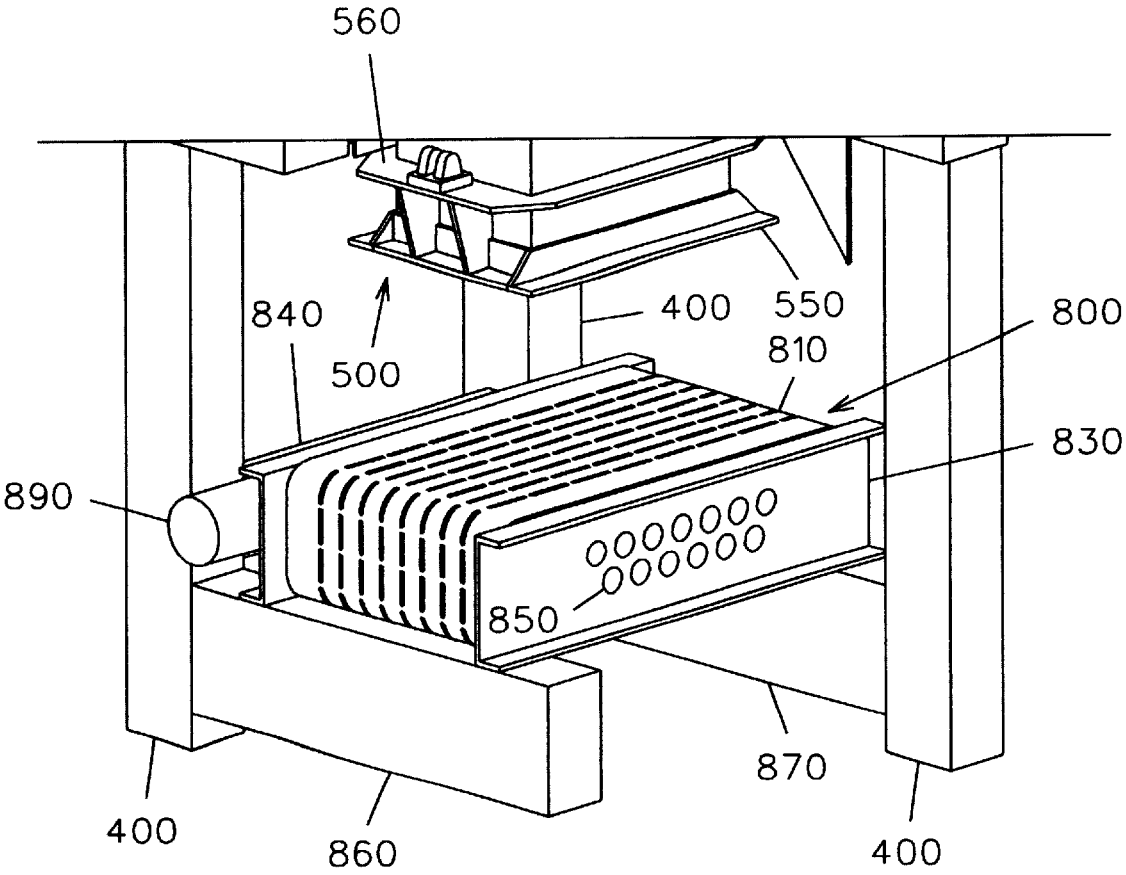
FIG. 6 is a fragmentary view on an enlarged scale of the compression chamber in a retracted position.
Figure 7:
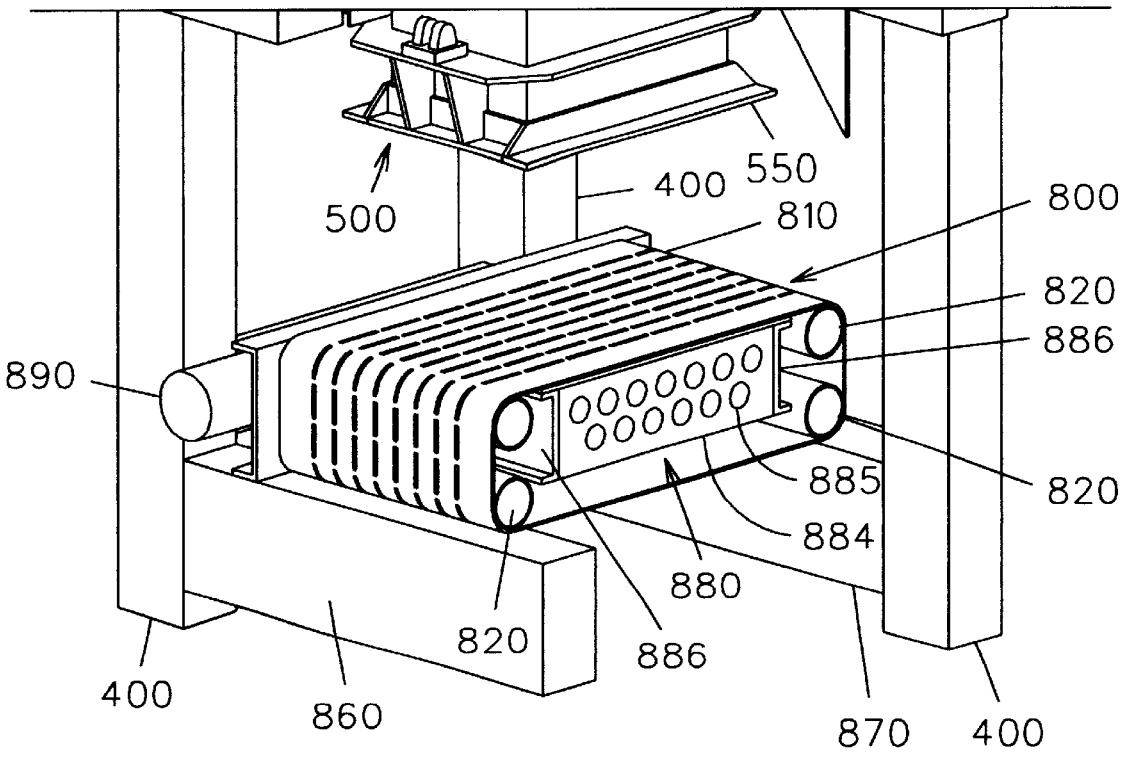
FIG. 7 is a fragmentary view as in FIG. 6 with an outer wall of the conveyor assembly framework removed.
Figure 8:
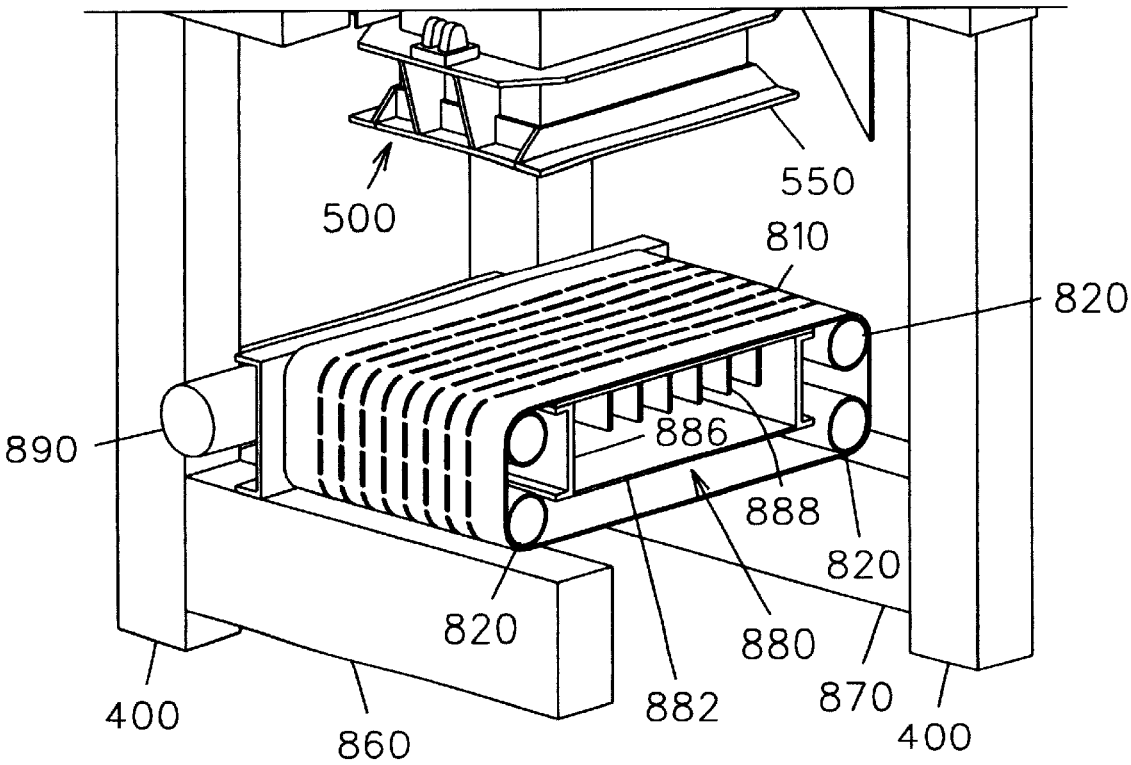
FIG. 8 is a fragmentary view as in FIG. 7 with a side wall of the air chamber removed.

As particularly shown in FIGS. 6–8, a first conveyor assembly 800 is located below the lower end of the tower 300, the first conveyor assembly 800 including a perforated conveyor belt 810 extending about rollers 820 between rails 830, 840. The first conveyor assembly 800 is supported by lower cross struts 860, 870. The first conveyor assembly 800 includes an air chamber 880 having a bottom wall 882 with upstanding side 884 and end walls 886. Within the air chamber 880, a series of vertical plates 888 underlie the conveyor belt 810. The side walls 884 and rails 830, 840 include a plurality of apertures 885, 850, respectively, such that air may be evacuated therefrom. Each rail 830, 840 is connected to the first blower 270 with conduit 890, an operation of which evacuates air from the air chamber 880 and from the compression chamber 500 when the chamber 500 is in its second extended position, as to be further described later.

The system 10 further includes a second conveyor assembly 900 horizontally adjacent the first conveyor assembly 800 and mounted to a framework. The second conveyor assembly 900 includes a conveyor belt 910 mounted about rollers. A third conveyor assembly 920 having a conveyor belt 930 is mounted to the framework and spaced above the second conveyor assembly 900 such that the respective conveyor belts 910, 930 contact the bottom and top surfaces of the material bulk once positioned therebetween. The space between the second 900 and third 920 conveyor assemblies is manually adjustable.

It is understood that the various conveyor belt assemblies 800, 900, 920 are powered in a conventional manner so as to convey and transfer materials therebetween. It is also understood that the extensions and retractions of the above described piston/cylinder combinations 570, 620 are also controlled in a conventional manner.

Figure 9:
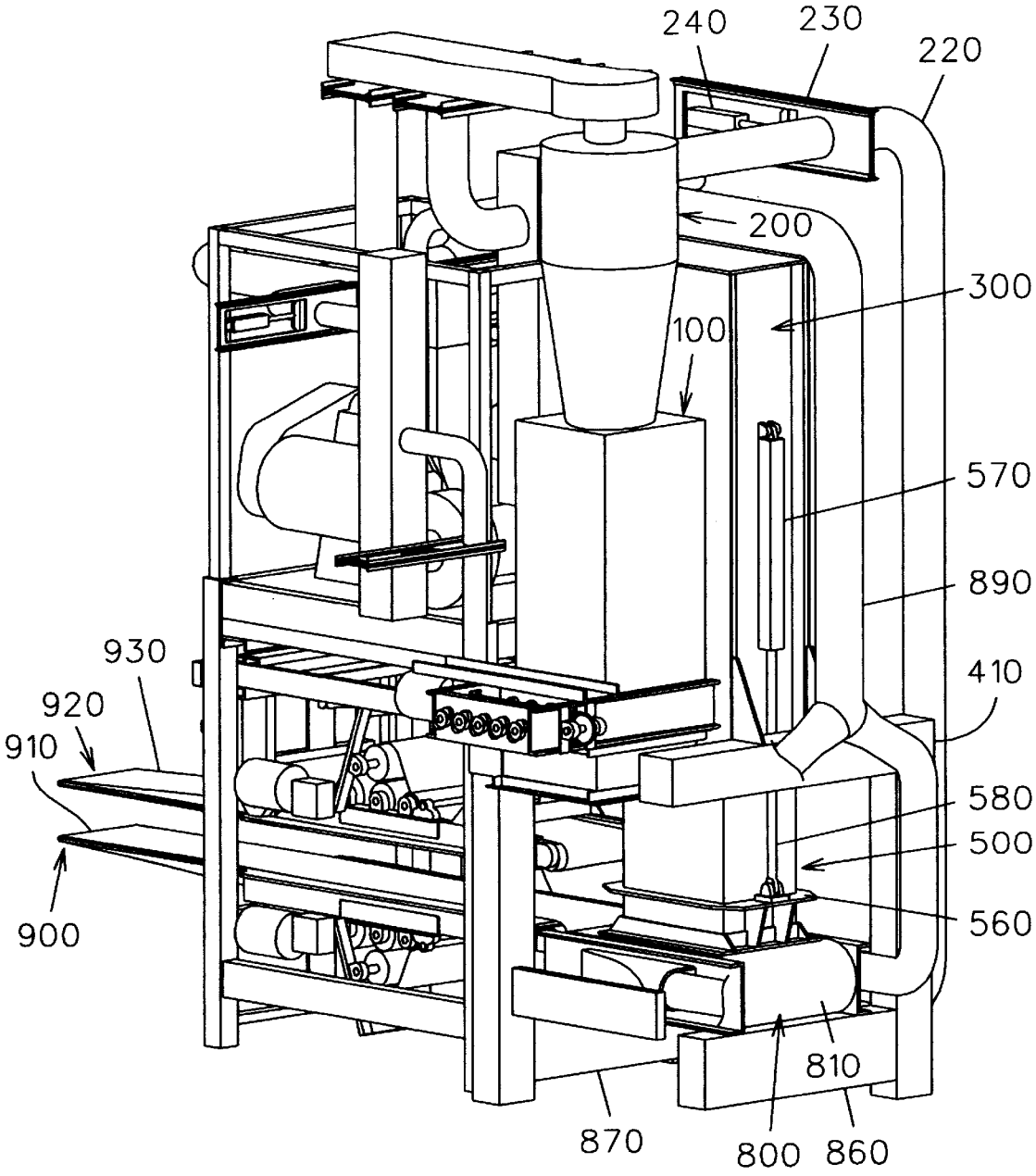
FIG. 9 is a front perspective view as in FIG. 1 with the compression chamber in an extended position.

In operation, the compression chamber 500 is positioned in its first retracted position wherein the chamber 500 is displaced from the first conveyor assembly 800. An operation of the first blower 270 causes air to be evacuated from the chamber 500 and loose particulate material to be drawn from the surge bin 260 into the cyclone 200. An operation of the second blower 140 then draws the particulate material into the feed hopper 100 by removing air therefrom. The chamber 500 is then reciprocatively lowered such that the lower end thereof contacts the conveyor belt 810 of the first conveyor assembly 800 (FIG. 9). With the gate 230 to the upstream portion 220 of the conduit between the cyclone 200 and surge bin 260 in a closed position, an operation of the first blower 270 draws the particulate material from the hopper 100 into the compression chamber 500 through the hopper outlet, tower inlet, and chamber inlet 512 and onto the perforated conveyor belt 810 of the first conveyor assembly 800. The inlets are in registration when the tower 300 is in its lowered position and the chamber 500 is in its raised position, as shown in FIG. 4. It should be appreciated, however, that particulate material may be transferred into the chamber 500 without the use of vacuum air pressure (e.g. with conveyor assemblies, etc.).

Figure 10:
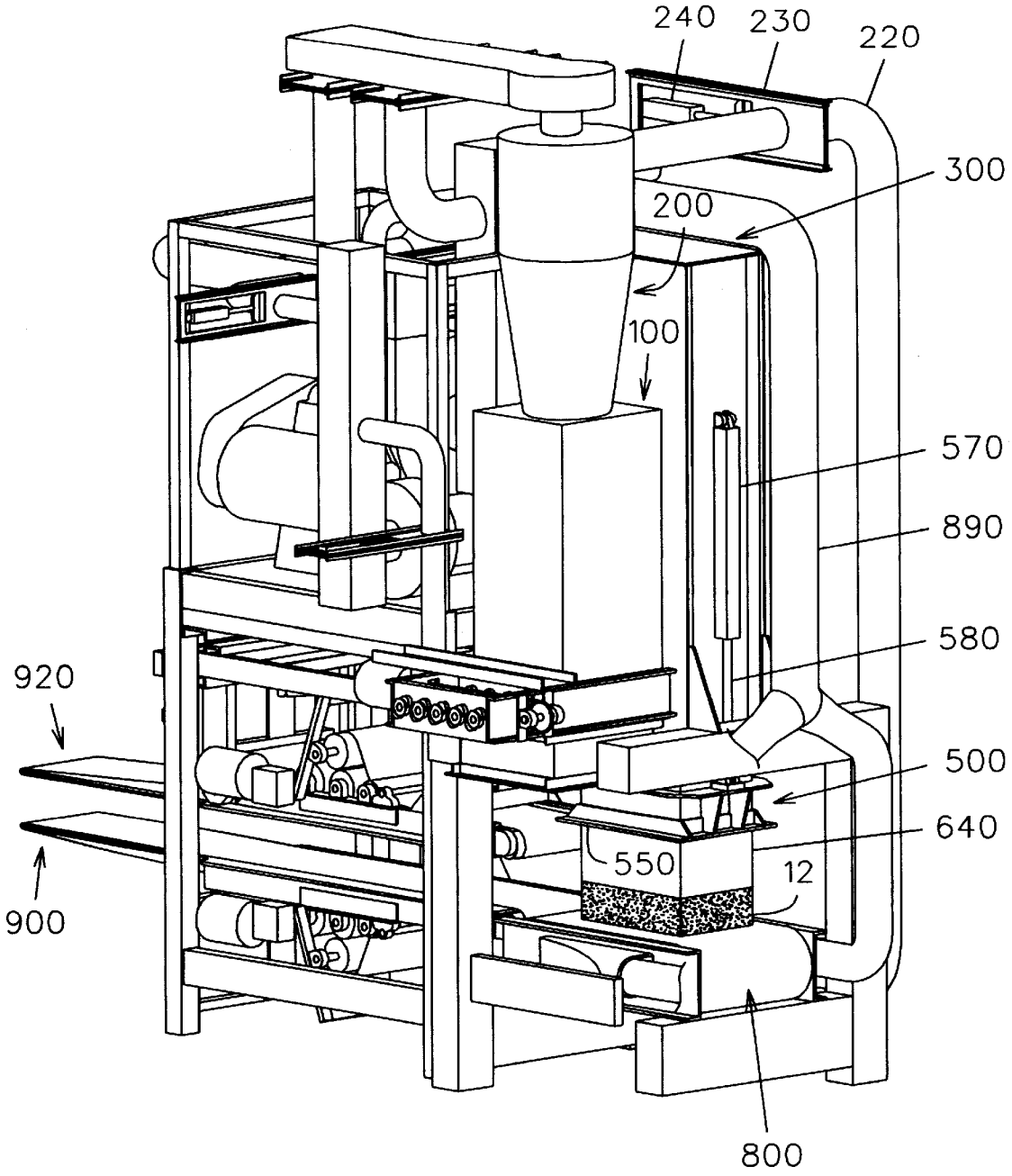
FIG. 10 is a front perspective view as in FIG. 9 with the compression chamber in a retracted position and the ram, assembly in an extended position.
Figure 11:
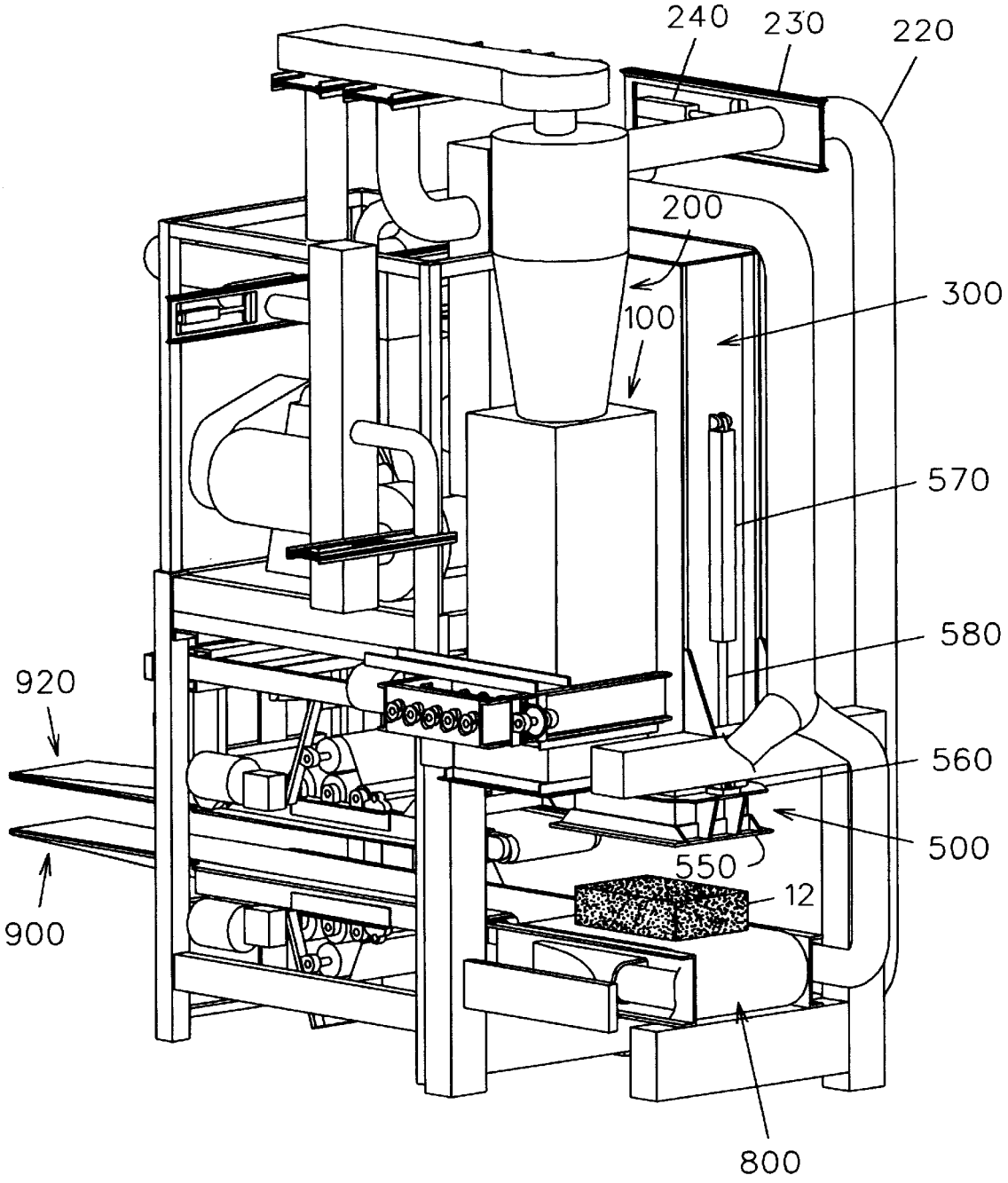
FIG. 11 is a front perspective view with the compression chamber in a retracted position and a material bulk on the conveyor surface.

As air is evacuated from the chamber through the first conveyor assembly 800, the particulate material is compressed atop the conveyor belt 810. The ram assembly 600 is then positioned in its extended position to further compress the particulate material into bulk form 12. Following formation of the material bulk 12, the chamber 500 is retracted to its first position and positive air pressure is introduced into the chamber 500 from the fourth blower 720 (FIG. 10). This positive air pressure assists the compression assembly 640 in separating from the material bulk 12 without dislodging material therefrom (FIG. 11). An operation of the first conveyor assembly 800 transfers the material bulk 12 to the second conveyor assembly 900 where the compression thereof is maintained between the second 900 and third 920 conveyor assemblies. It should be appreciated that the first conveyor assembly 800 may be a fixed platform and the compressed material bulk 12 may be ram directed therefrom to the space between the second 900 and third 920 conveyor assemblies (not shown).

It is understood that while certain forms of this invention have been illustrated and described, it is not limited thereto except insofar as such limitations are included in the following claims and allowable functional equivalents thereof.

Having thus described the invention, what is claimed as new and desired to be secured by Letters Patent is as follows:

1. A system for forming particulate material in a bulk form, comprising:

a compression tower having an opening at a lower end thereof;

a first platform having an upper surface displaced from said lower end of said tower;

a chamber having openings at upper and lower ends thereof, said chamber selectably movable between a first chamber position wherein said lower end of said chamber is displaced from said upper surface and a second chamber position wherein said lower end of said chamber is adjacent said upper surface, whereby said opening at said lower end of said chamber is closed when said chamber is at said second chamber position;

a ram assembly in said chamber having a first ram position adjacent said upper end of said chamber and delectably extendable to a second ram position adjacent said lower end of said chamber when said chamber is at said second chamber position;

an inlet in said tower;

an inlet in said chamber registering with said tower inlet when said chamber is at said second chamber position and said ram assembly is at said first ram position, whereby particulate material can be transferred through said inlet of said chamber when said chamber is at said second chamber position, and an extension of said ram to said second ram position compresses said material into a bulk form atop said upper surface.

2. A system as in claim 1 wherein said chamber comprises:

a piston/cylinder assembly including a cylinder and a piston rod therein, said rod reciprocatively movable between a first retracted position relative to said cylinder and a second extended position relative to said cylinder; and means for mounting said piston/cylinder assembly to said tower whereby said chamber is moved between said first and second chamber positions by a movement of said rod between said first and second rod positions, respectively.

3. A system as in claim 1 wherein said ram assembly comprises:

a piston/cylinder assembly including a cylinder and a piston rod therein, said rod reciprocatively movable between a first retracted position relative to said cylinder and a second extended position relative to said cylinder, said piston/cylinder assembly mounted to said tower and extending through said opening in said top of said chamber; and a compression plate mounted to said rod for reciprocative movement with said rod, said rod moving said compression plate to said second extended position for compression of said material.

4. A system as in claim 1 further comprising:

a first conveyor longitudinally adjacent said platform;

a second conveyor vertically displaced from said first conveyor to present a space for receipt of said material bulk therebetween; and means for transferring said material bulk from said platform to said space between said first and second conveyors, an operation of said first and second conveyors conveying said material bulk to a downstream location for packaging.

5. A system as in claim 1 wherein said platform comprises:

a perforate surface presenting said top surface; and at least one support plate underlying said top surface.

6. A system as in claim 1 further comprising a means for transferring said particulate material through said chamber inlet when said chamber is at said second chamber position, said means for transferring comprising a vacuum motor coupled to said first conveyor for drawing said particulate material into said chamber and onto said conveyor surface when said chamber is at said second chamber position and said ram assembly is at said first ram position.

7. A system for forming particulate material in a bulk form, comprising:

a compression tower defined by a series of walls, said tower including an opening at a lower end thereof;

a first conveyor having a conveyor surface displaced from said lower end of said tower;

a chamber in said tower and having openings at upper and lower ends thereof, said chamber selectably movable between a first chamber position wherein said lower end of said chamber is displaced from said conveyor surface and a second chamber position wherein said lower end of said chamber is adjacent said conveyor surface, whereby said opening at said lower end of said chamber is closed when said chamber is at said second chamber position;

a ram assembly in said chamber having a first ram position adjacent said upper end of said chamber and selectably extendable to a second ram position adjacent said lower end of said chamber when said chamber is at said second chamber position;

an inlet in said tower;

an inlet in said chamber registering with said tower inlet when said chamber is at said second chamber position and said ram assembly is at said first ram position; and vacuum means for transferring particulate material through said tower and chamber inlets when said chamber is at said second chamber position and said ram assembly is at said first ram position, said particulate matter falling on said conveyor surface, said vacuum means evacuating air from said chamber for compressing said particulate material into a bulk form atop said conveyor surface, an extension of said ram to said second ram position further compressing said material into a bulk form atop said conveyor surface.

8. A system as in claim 7 further comprising:

a second conveyor longitudinally adjacent said first conveyor; and a third conveyor vertically displaced from said second conveyor to present a space for receipt of said material bulk therebetween, an operation of said first conveyor transferring said material bulk to said space between said second and third conveyors, an operation of said second and third conveyors conveying said material bulk to a downstream location for packaging.

9. A system as in claim 7 wherein said chamber comprises:

a piston/cylinder assembly including a cylinder and a piston rod therein, said rod reciprocatively movable between a first retracted position relative to said cylinder and a second extended position relative to said cylinder; and means for mounting said piston/cylinder assembly to said tower whereby said chamber is moved between said first and second chamber positions by a movement of said rod between said first and second rod positions, respectively.

10. A system as in claim 7 wherein said ram assembly comprises:

a piston/cylinder assembly including a cylinder and a piston rod therein, said rod reciprocatively movable between a first retracted position relative to said cylinder and a second extended position relative to said cylinder, said piston/cylinder assembly mounted to said tower and extending through said opening in said top of said chamber; and a compression plate mounted to said rod for reciprocative movement with said rod, said rod moving said compression plate to said second extended position for compression of said material.

11. A system as in claim 7 wherein said second and third conveyors contact said material bulk to enhance said conveying-of said material bulk.

12. A system as in claim 7 wherein said first conveyor comprises:

a perforated conveyor belt presenting said conveyor surface;

an air chamber defined by a series of walls and having an open top; and a plurality of upstanding support plates in said air chamber and underlying said conveyor surface, said air chamber being in communication with said vacuum means such that air is vacuumed from said chamber through said perforated conveyor belt.

13. A system as in claim 7 further comprising:

a funnel shaped structure upstream from said tower adapted to circulate said particulate matter so as to inhibit formation of lumps therein;

a hopper defined by a series of walls and coupled to a lower end of said funnel shaped structure, said hopper having an outlet registering with said inlet in said tower; and a second vacuum means for drawing said particulate material from said funnel shaped structure into said hopper, said second vacuum means removing air from said particulate material.

14. A system for forming particulate material in a bulk form, comprising:

a compression tower defined by a series of upstanding walls and a top, said tower including an opening at a lower end thereof;

a first conveyor having a perforated conveyor surface displaced from said lower end of said tower;

a chamber in said tower and having openings at upper and lower ends thereof, said chamber selectably movable between a first chamber position wherein said lower end of said chamber is displaced from said conveyor surface and a second chamber position wherein said lower end of said chamber is adjacent said conveyor surface, whereby said opening at said lower end of said chamber is closed when said chamber is at said second chamber position;

a ram assembly in said chamber having a first ram position adjacent said upper end of said chamber and delectably extendable to a second ram position adjacent said lower end of said chamber when said chamber is at said second chamber position;

an inlet in said tower;

an inlet in said chamber registering with said tower inlet when said chamber is at said second chamber position and said ram assembly is at said first ram position; and first vacuum means for drawing particulate material through said tower and chamber inlets, said particulate material falling on said conveyor surface, said vacuum means evacuating air through said perforated conveyor surface for compressing said particulate material into a bulk form atop said conveyor surface, an extension of said ram to said second ram position further compressing said material into a bulk form atop said conveyor surface.

15. A system as in claim 14 wherein said chamber comprises:

a piston/cylinder assembly including a cylinder and a piston rod therein, said rod being reciprocatively movable between a first retracted position relative to said cylinder and a second extended position relative to said cylinder; and means for mounting said piston/cylinder assembly to said tower whereby said chamber is moved between said first and second chamber positions by a movement of said rod between said first and second rod positions, respectively.

16. A system as in claim 14 wherein said ram assembly comprises:

a piston/cylinder assembly including a cylinder and a piston rod therein, said rod being reciprocatively movable between a first retracted position relative to said cylinder and a second extended position relative to said cylinder, said piston/cylinder assembly mounted to said tower and extending through said opening in said top of said chamber; and a compression plate mounted to said rod for reciprocative movement with said rod, said rod moving said compression plate to said second extended position for compression of said material.

17. A system as in claim 14 wherein said second and third conveyors contact said material bulk to enhance said conveying of said material bulk.

18. A system as in claim 14 wherein said first conveyor comprises:

a perforated conveyor belt presenting said perforated conveyor surface;

an air chamber defined by a series of walls and having an open top; and a plurality of upstanding support plates in said air chamber and underlying said conveyor surface, said air chamber being in communication with said first vacuum means for evacuating air from said chamber through said perforated conveyor belt.

19. A system as in claim 14 further comprising:

a funnel shaped structure upstream from said tower adapted to circulate said particulate matter so as to inhibit formation of lumps therein;

a hopper defined by a series of walls and coupled to a lower end of said funnel shaped structure, said hopper having an outlet registering with said inlet in said tower; and second vacuum means for drawing said particulate material from said funnel shaped structure into said hopper, said second vacuum means removing air from said particulate material.

20. A system as in claim 14 further comprising:

a second conveyor longitudinally adjacent said first conveyor; and a third conveyor vertically displaced from said second conveyor to present a space for receipt of said material bulk therebetween, an operation of said first conveyor means transferring said material bulk to said space between said second and third conveyors, an operation of said second and third conveyors conveying said material bulk to a downstream location for packaging.

* * * * *